US007628685B2

(12) United States Patent
Enomoto

(10) Patent No.: US 7,628,685 B2
(45) Date of Patent: Dec. 8, 2009

(54) COIN HOPPER

(75) Inventor: Minoru Enomoto, Saitama (JP)

(73) Assignee: Asahi Seiko Co., Ltd., Tokyo (JP)

( * ) Notice: Subject to any disclaimer, the term of this patent is extended or adjusted under 35 U.S.C. 154(b) by 16 days.

(21) Appl. No.: 11/869,994

(22) Filed: Oct. 10, 2007

(65) Prior Publication Data

US 2008/0090509 A1 Apr. 17, 2008

(30) Foreign Application Priority Data

Oct. 12, 2006 (JP) ..... 2006-278295

(51) Int. Cl.
*G07D 1/00* (2006.01)

(52) U.S. Cl. ..... 453/57

(58) Field of Classification Search ..... 453/34, 453/35, 49, 52, 53, 57
See application file for complete search history.

(56) References Cited

U.S. PATENT DOCUMENTS 1,110,268 A * 9/1914 Huntington ..... 232/62
2,955,605 A * 10/1960 Antonoff ..... 453/34
4,036,242 A * 7/1977 Breitenstein et al. ..... 453/30
4,798,558 A * 1/1989 Bellis ..... 453/32
5,285,883 A * 2/1994 Le Hong et al. ..... 194/317
7,144,318 B2 * 12/2006 Wei ..... 453/57
2004/0035682 A1 * 2/2004 Jerry ..... 198/469.1
2005/0009464 A1 * 1/2005 Nireki et al. ..... 453/57

FOREIGN PATENT DOCUMENTS

EP 0 957 456 B1 11/1999

* cited by examiner

*Primary Examiner*—Patrick Mackey
*Assistant Examiner*—Mark Beauchaine
(74) *Attorney, Agent, or Firm*—McGlew and Tuttle, P.C.

(57) ABSTRACT

A coin hopper is provided that can dispense coins of different diameters without any trouble. A rotating disk has coin stoppers that are upwardly inclined at a specified angle, and a circular supporting rack at the center of the upper surface thereof. The stoppers expand radially at regular intervals, from the supporting rack side to the circumferential direction. The rotating disk makes the coins contact a holding surface between the coin stoppers and receives the coins one by one, and supports them by the supporting rack and feeds them out. An outer covering unit covers at least the lower outer circumference of the rotating disk. A storing bowl stores coins in bulk following the outer covering unit. A coin receiving unit expands from the vicinity of the supporting rack to the circumferential direction of the rotating disk, wherein the coin stoppers are arranged in a state fixed to the rotating disk. The coin receiving unit is arranged so as to contact and get away from the holding surface of the rotating disk.

20 Claims, 12 Drawing Sheets

COIN HOPPER

CROSS REFERENCE TO RELATED APPLICATIONS

This application claims the benefit of priority under 35 U.S.C. §119 of Japan Patent Application 2006-278295 filed Oct. 12, 2006, the entire contents of which are incorporated herein by reference.

FIELD OF THE INVENTION

The present invention relates to a coin hopper that sorts and dispenses coins one by one, which coins are stored in bulk in a storing bowl. More particularly, the present invention relates to a coin hopper that can sort and dispense coins one by one which have different diameters and are stored in bulk in a storing bowl. The coin hoper can precisely feed coins one by one which have different diameters. The term coin used herein includes value disks, coins, game machine medals, tokens, and the like.

BACKGROUND OF THE INVENTION

In the prior art, a coin hopper is known that can sort and dispense coins one by one which are stored in bulk in a storing bowl, and have different diameters. European Patent Application Publication No. 0957456 (FIG. 1 to FIG. 7, page 2 to page 4) discloses such a device with an upper surface of an upwardly inclined rotating disk on which a circular supporting rack that protrudes at the center of the rotating disk is arranged. Coin stoppers are arranged radially from the supporting rack side so as to freely advance to and retreat from the rotating disk. A coin receiving knife is arranged at a specified position. A coin is supported by the supporting rack, and is pushed by the coin stoppers and is received in the circumferential direction of the rotating disk by the receiving knife. After the coin concerned is received, the coin stoppers are pushed into the rotating disk by the receiving knife and the receiving knife is made to retreat. In European Patent Application Publication No. 0957456, the coin stoppers of for example eight plate-like bodies are arranged radially, and at regular intervals, and are elastically biased so as to protrude from the surface of the rotating disk, and after the coin stoppers transfer coins to the receiving knife, it is pushed into the rotating disk by the receiving knife, and made to retreat. Since this coin hopper can dispense coins held between the coin stoppers, and has an advantage that it can dispense coins of diameters in a specified range. The coin hopper in principle receives coins that customers throw in, arranged in a casing of a game machine or the like. Although it rarely occurs, there is a case where a customer throws a bar-like piece and the like together with coins into a coin slot. It may occur that this bar-like piece is pinched in the advance/retreat hole of the coin stoppers, and the coin stoppers are held in the retreat position and cannot move. In the case when the coin stoppers are held in the retreat position continuously, coins cannot be stopped by the coin stoppers, and accordingly, coins are dispensed with some missing, and in an extreme case, all the coin stoppers are held at the retreat position and cannot dispense the coin, which has been a problem in the prior art.

SUMMARY OF THE INVENTION

The present invention has been made in consideration of the above problem in the prior art, and accordingly, a first object of the present invention is to provide a coin hopper that can dispense coins of different diameters without any trouble.

A second object of the present invention is to provide a compact coin hopper in which the coin stoppers are not held at the retreat position, and that can dispense coins of different diameters without any trouble.

A third object of the present invention is to provide a coin hopper that can avoid breakage and the like of parts, even in the case of a coin dispensing failure.

In order to achieve the above object, according to one aspect of the present invention, there is provided a coin hopper comprising coin stoppers that are upwardly inclined at a specified angle, and a circular supporting rack is formed at the center of the upper surface thereof and expands radially at regular intervals, and from the supporting rack side to the circumferential direction. A rotating disk makes the coins contact a holding surface between the coin stoppers and receives the coins one by one, and supports them by the supporting rack and feeds them out. An outer covering unit covers at least the lower outer circumference of the rotating disk. A storing bowl that stores coins in bulk follows the outer covering unit. A coin receiving means expands from the vicinity of the supporting rack to the circumferential direction of the rotating disk, wherein the coin stoppers are arranged in a state fixed to the rotating disk, and the coin receiving means is arranged so as to contact and get away from the holding surface of the rotating disk.

According to another aspect of the present invention, there is provided a coin hopper wherein the coin receiving means is supported so as to freely move in a specified range above the rotating disk by a free supporting means, and is biased by a specified force so as to come close to the holding surface of the rotating disk by a biasing means.

According to another aspect of the present invention, there is provided a coin hopper wherein the free supporting means is a spherical bearing means.

According to another aspect of the present invention, there is provided a coin hopper wherein the downstream end portion in the rotating direction of the coin stoppers has a specified angle to the supporting rack, so that when it opposes the coin receiving means, the coin receiving unit contacts the holding surface at the same time.

According to another aspect of the present invention there is provided a coin hopper that further comprises a dropping means that biases coins toward the supporting rack at the upper portion than the center of the rotating disk.

According to another aspect of the present invention, there is provided a coin hopper wherein a torque limiter is further arranged in the transmission route between the rotating disk and the rotation drive means.

In the present invention, the coin stoppers are arranged in a state fixed to the rotating disk. Therefore, coins stored in bulk in the storing bowl move to the side of the rotating disk upwardly inclined at a specified angle by the inclination of the bottom wall of the storing bowl, and contact the upper surface of the rotating disk at specified contact pressure.

Coins in bulk are stirred by the coin stoppers of the rotating disk, engaged by coin stopper and contact the holding surface between the coin stoppers.

The coins that contact the surface are guided by the outer covering unit that covers at least the lower outer circumference of the rotating disk at the lower position than the horizontal line, and on the other hand when the coin stoppers are at the upper position than the horizontal line, the coins move on the coin stoppers and are supported by the supporting rack at the center of the rotating disk, and are received one by one among the coin stoppers.

The coins that are supported by the supporting rack, and pushed by the coin stoppers are received by the coin receiving means, and dispensed.

When the coin stoppers reach the coin receiving means, the coin receiving means is pushed up by the coin stoppers, and gets away from the holding surface, and accordingly the coin stoppers can pass the lower side of the coin receiving means.

In the present invention, the coin stoppers are fixed to the rotating disk. In other words, since the coin stoppers do not move relative to the rotating disk, the nonconforming situation in which they are held at the retreat position by a bar-like body or the like does not occur.

Accordingly, it is possible to precisely dispense coins of different diameters. The coin receiving means is supported so as to freely move in a specified range above the rotating disk by a free supporting means, and the coin receiving means is biased by a specified force so as to come close to the holding surface of the rotating disk by a biasing means. At the moment when coins are supported by the coin receiving means, the coin receiving means is floated from the supporting rack side end to the holding surface by the coin stoppers. In other words, the coin receiving means performs a three-dimensional movement where it becomes inclined to the holding surface, thereafter, it becomes parallel, and then is inclined again. Since the coin receiving means is supported by the free supporting means, it can perform the three-dimensional movement by one supporting means, and accordingly there is an advantage that the device can be made compact.

With the free supporting means is a spherical bearing unit, there is an advantage that the structure can be made simple, and at a low cost.

With the downstream end portion in the rotating direction of the coin stoppers having a specified angle to the supporting rack, when it opposes the coin receiving means, the coin receiving means contacts the holding surface at the same time. Thereby, the full length of the coin receiving means contacts the holding surface of the rotating disk again from the coin stoppers at the same time. Therefore, even when the coin is at the downstream side edge of the coin stoppers, the coin receiving unit does not ride on the coin, and there is an advantage that it is possible to dispense following coins without any trouble.

A dropping means that biases coins toward the supporting rack at the upper portion than the center of the rotating disk is further arranged advantageously. In this structure, the dropping means contacts coins that are stopped by the supporting rack and the coin stoppers, and pushes them to the supporting rack. Since the supporting rack does not protrude more than the thickness of the thinnest coin, the piled coins at the upper side are moved to the above the supporting rack by the dropping means. In other words, the coins that are on the coin that contacts the holding surface are dropped by the dropping means, and only one coin is positioned between the coin stoppers. Accordingly, there is an advantage that only one coin is received precisely by the coin receiving body, and is dispensed.

A torque limiter arranged in the transmission route between the rotating disk and a rotation drive unit provides advantages. For example, when a coin is pinched between the coin receiving means and the coin stopper and does not move, and a load over the set torque works on the torque limiter, the driving force of the rotation drive means is released by the torque limiter, and the rotating disk, in other words, the coin stoppers do not move. Accordingly, since an unexpected and unreasonable force will not work onto the coin receiving means and the coin stoppers, there is an advantage that it is possible to prevent breakage and the like of these components.

According to the present invention, the coin hopper comprises coin stoppers that are upwardly inclined at a specified angle, and a circular supporting rack is formed at the center of the upper surface thereof and expands radially at regular intervals, and from the supporting rack side to the circumferential direction. The rotating disk makes the coins contact a holding surface between the coin stoppers and receives the coins one by one, and supports them by the supporting rack and feeds them out. An outer covering unit covers at least the lower outer circumference of the rotating disk. A storing bowl stores coins in bulk following the outer covering unit. A coin receiving means expands from the vicinity of the supporting rack to the circumferential direction of the rotating disk, wherein the coin stoppers are arranged in a state fixed to the rotating disk. The coin receiving means is arranged so as to contact and get away from the holding surface of the rotating disk. Further, the coin receiving body is supported so as to freely move in a specified range above the rotating disk by a spherical bearing, and is biased, by a specified force so as to come close to the holding surface of the rotating disk, by an biasing means. Furthermore, a dropping means that biases coins toward the supporting rack at the upper portion than the center of the rotating disk may be provided. A torque limiter may be interposed in the transmission route between the rotating disk and the a rotation drive means.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

BRIEF DESCRIPTION OF THE DRAWINGS

In the drawings:

FIG. 12Ab is an explanatory sectional view showing an aspect of the operation of a coin hopper according to a preferred embodiment of the present invention;

FIG. 12Bb is an explanatory sectional view showing an aspect of the operation of a coin hopper according to a preferred embodiment of the present invention;

FIG. 12Cb is an explanatory sectional view showing an aspect of the operation of a coin hopper according to a preferred embodiment of the present invention.

DESCRIPTION OF THE PREFERRED EMBODIMENT

Figure 1:
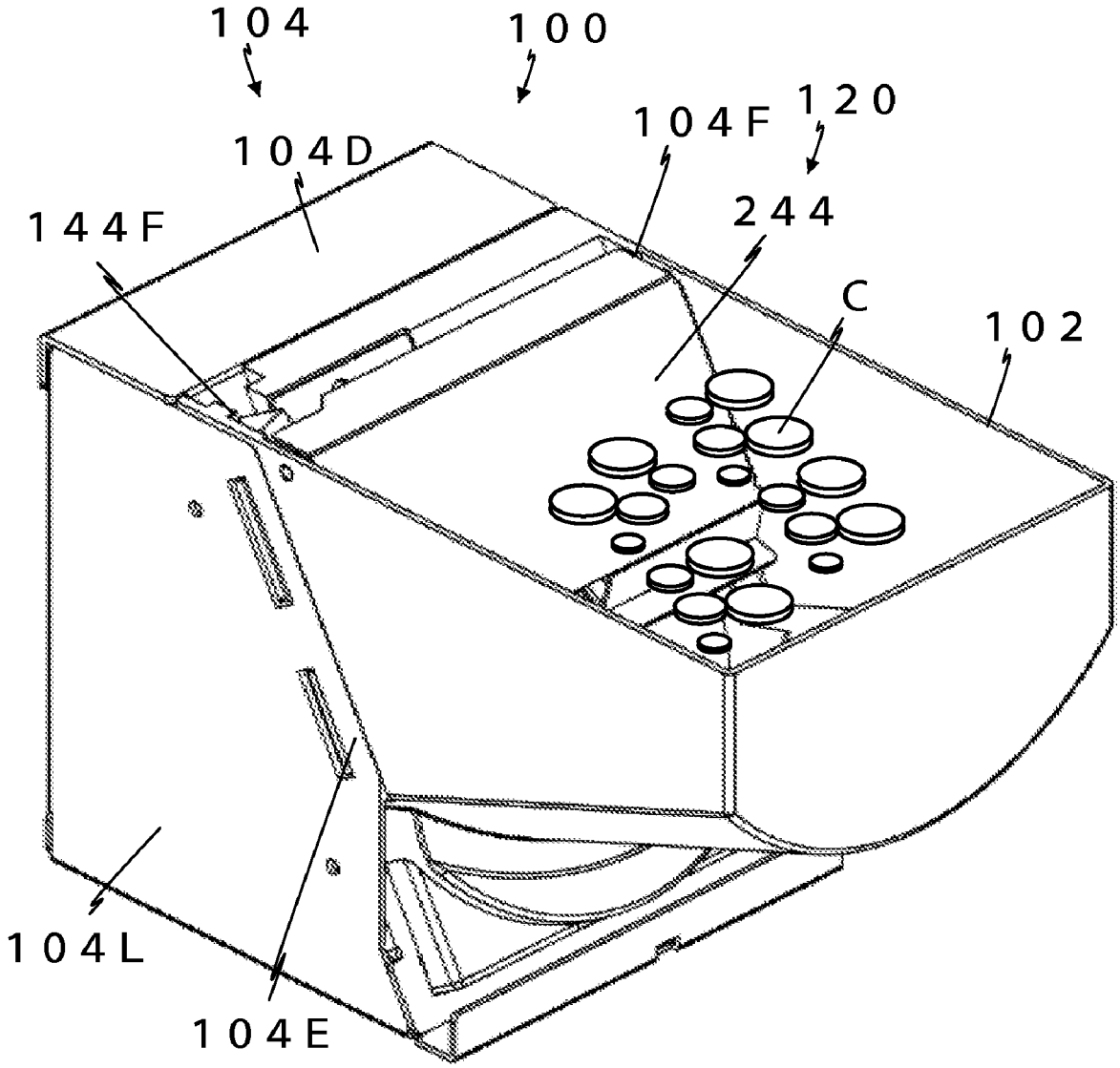
FIG. 1 is a perspective view showing a coin hopper according to a preferred embodiment of the present invention.
Figure 2:
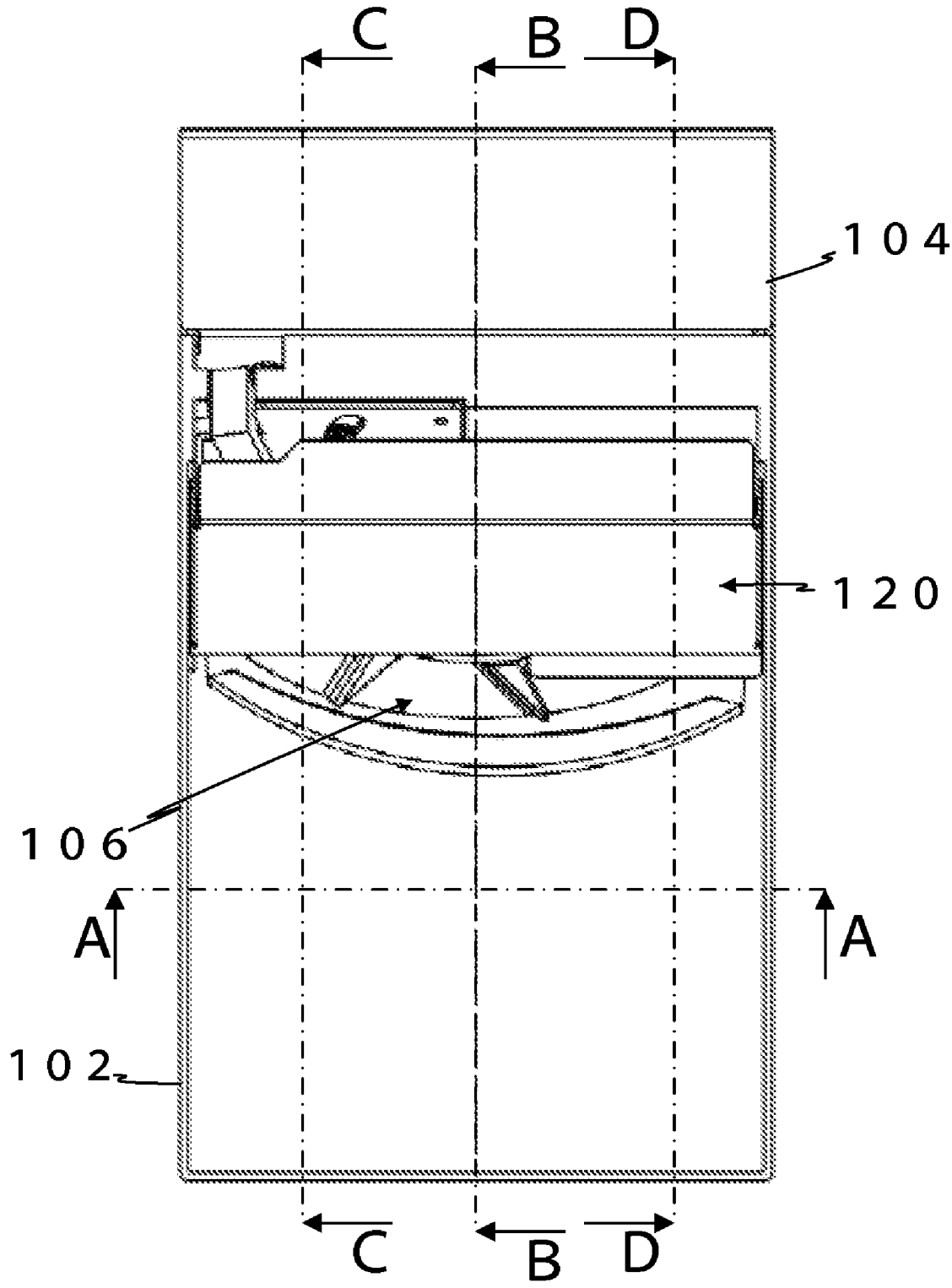
FIG. 2 is a plan view showing a coin hopper according to a preferred embodiment of the present invention.
Figure 3:
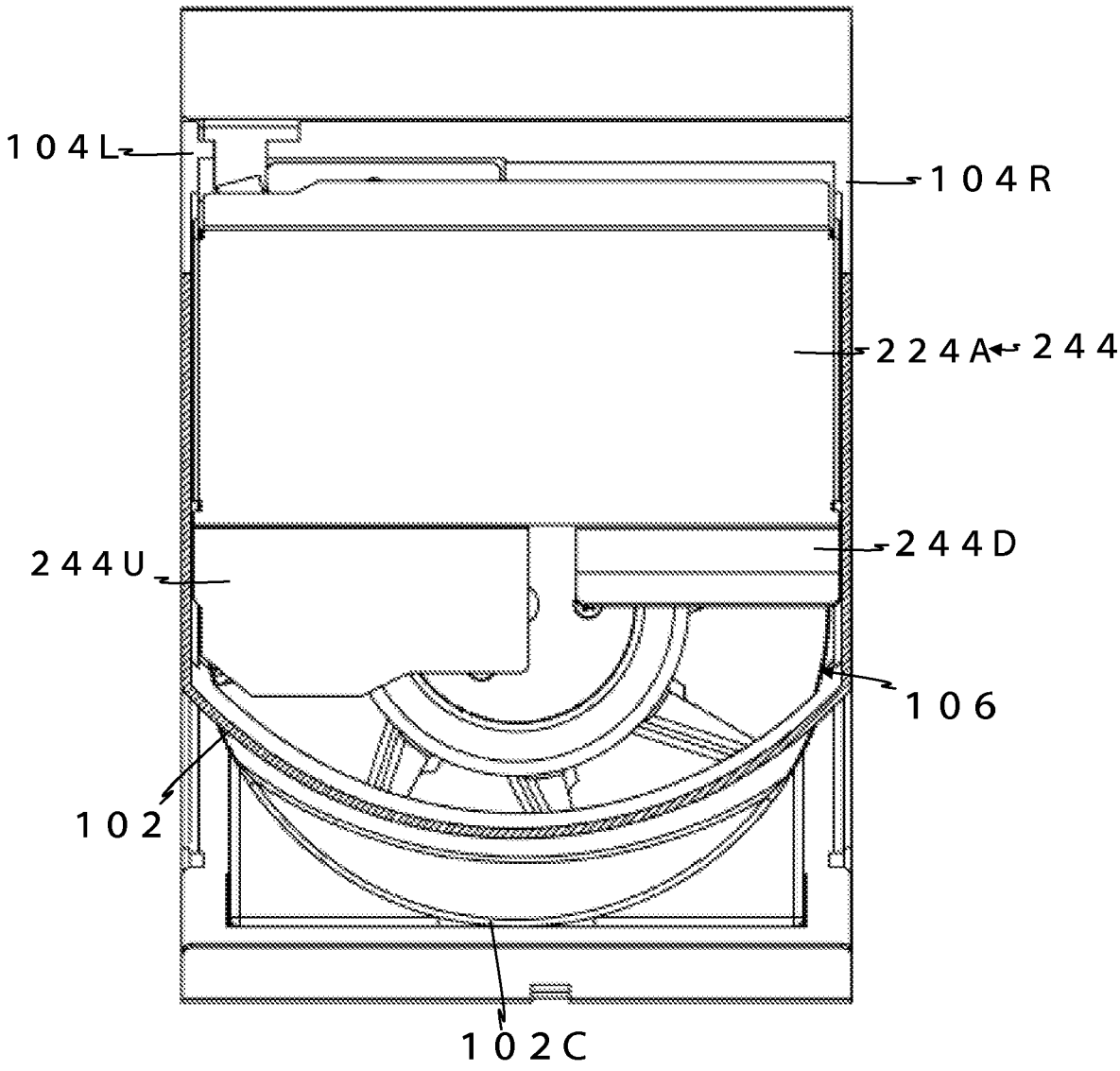
FIG. 3 is a sectional view cut at the surface parallel to a rotating disk taken along line A-A in FIG. 2, showing a coin hopper according to a preferred embodiment of the present invention.
Figure 4:
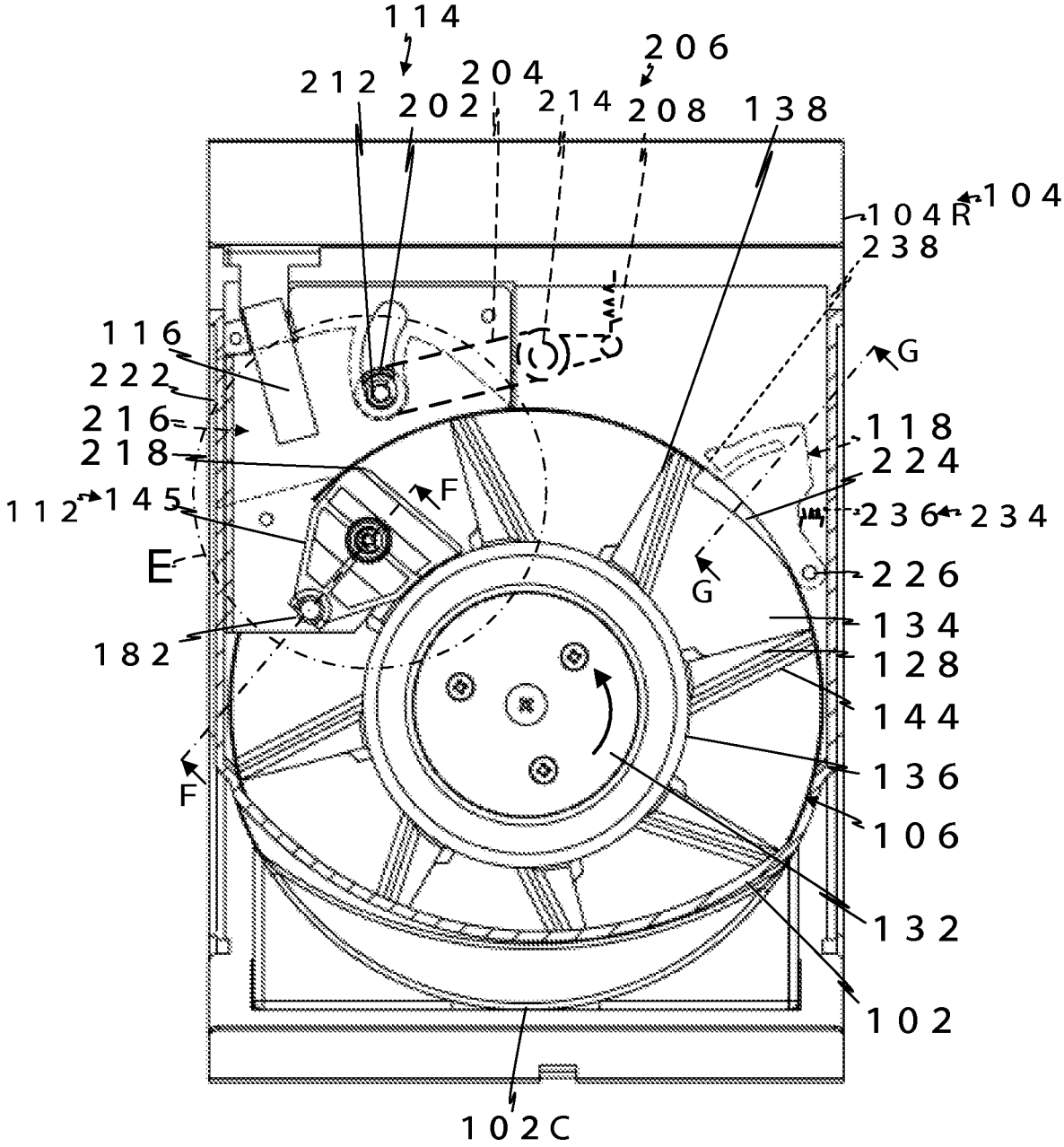
FIG. 4 is a sectional view in the same manner as in FIG. 3, where a regulating plate of a coin hopper according to a preferred embodiment of the present invention is removed.
Figure 5:
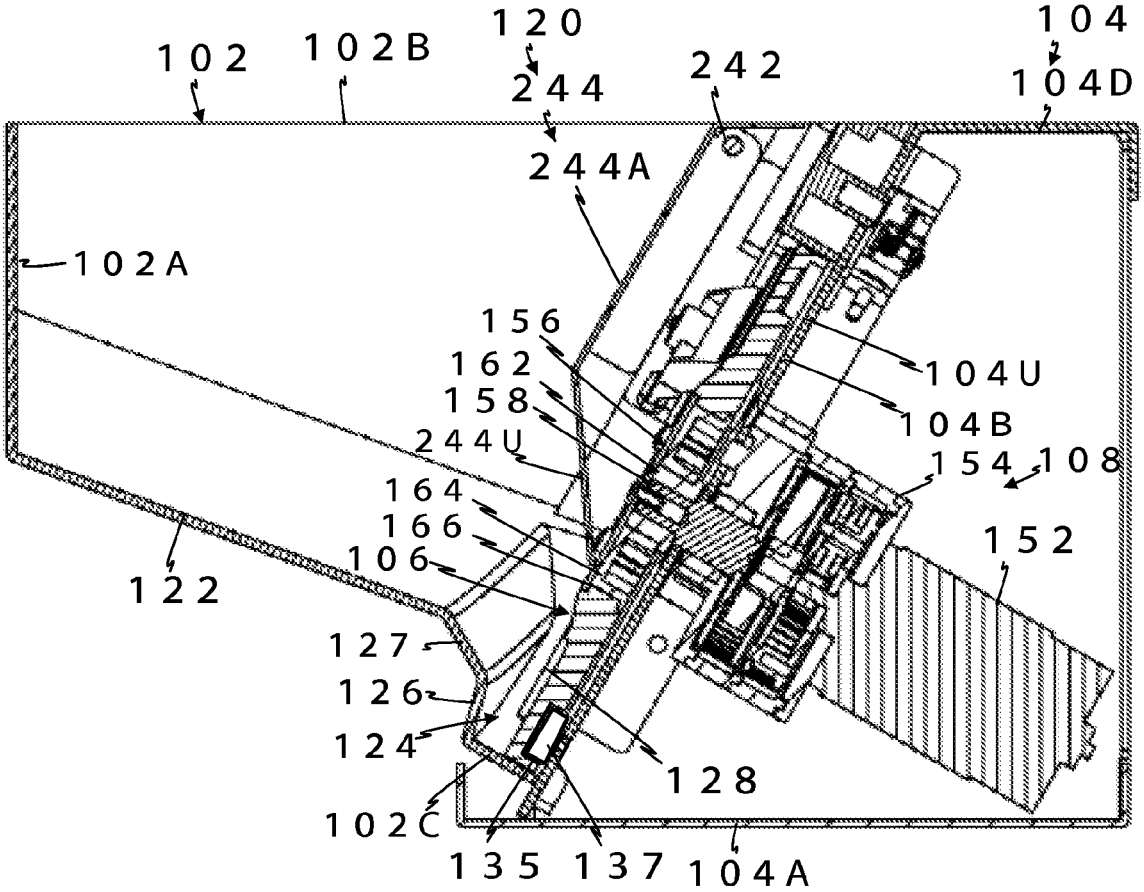
FIG. 5 is a cross sectional view taken along line B-B in FIG. 2.
Figure 6:
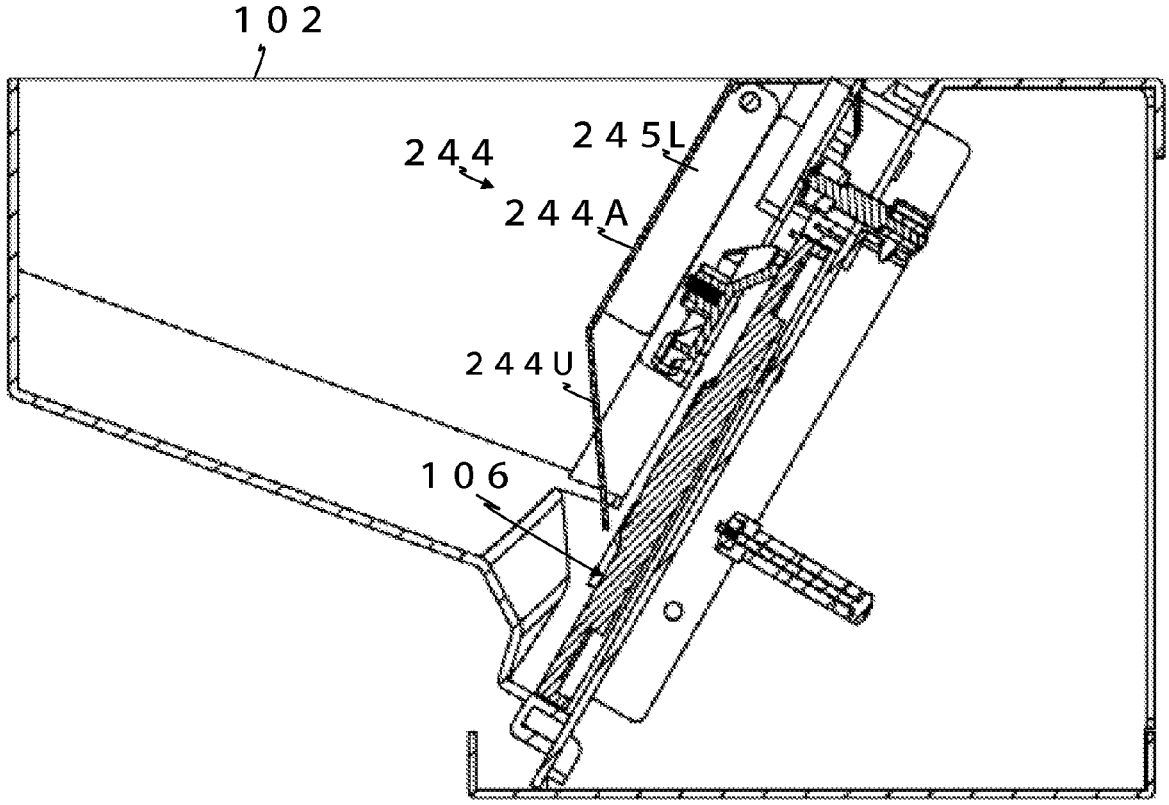
FIG. 6 is a cross sectional view taken along line C-C in FIG. 2.
Figure 7:
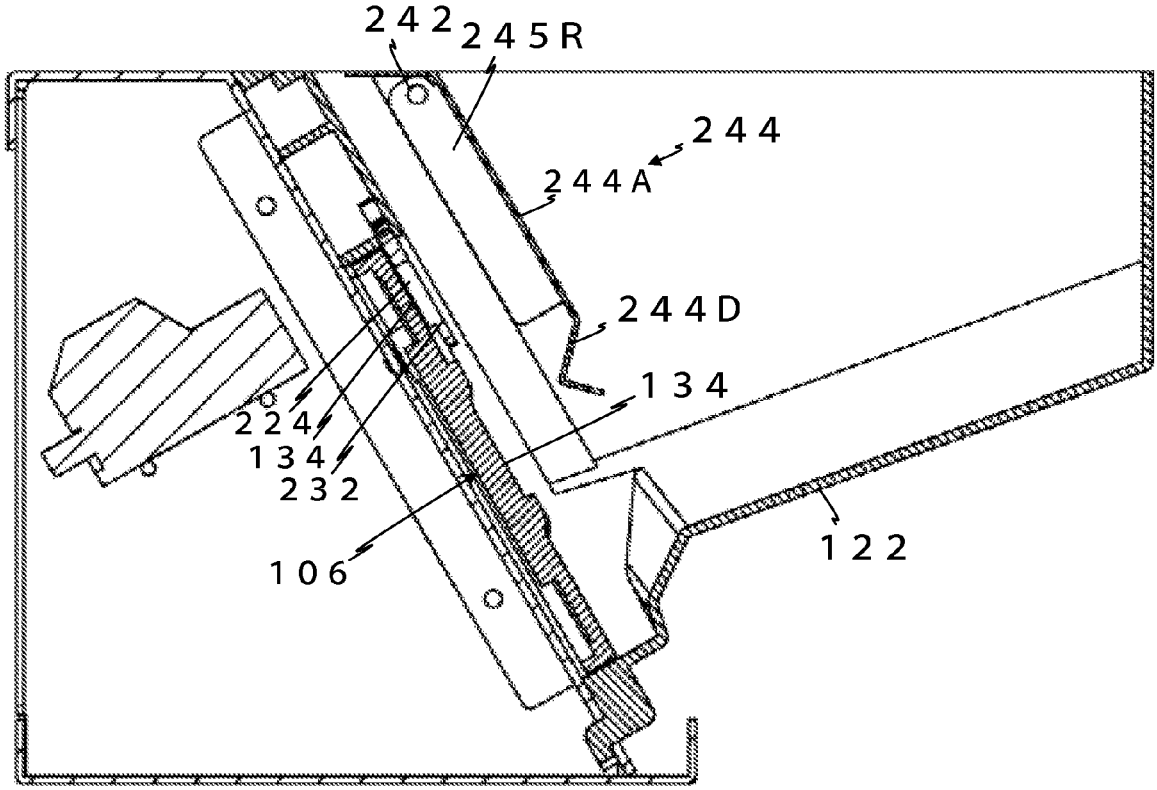
FIG. 7 is a cross sectional view taken along line D-D in FIG. 2.

Referring to the drawings and in particular FIG. 1, FIG. 4 and FIG. 5, a coin hopper 100 according to the invention includes a storing bowl 102 that stores many coins in bulk. An attachment base 104 supports and fixes the storing bowl 102 and is upwardly inclined. A rotating disk 106 sorts coins C one by one. The hopper 100 also includes a drive unit 108 of the rotating disk 106, a coin receiving means 112, a hopping means 114 of coins C, a detecting means 116 of coins C, a dropping means 118 of coins C and a regulating means 120 of coins C.

The storing bowl 102 is explained first. The storing bowl 102 has a function to store many coins C in bulk, and feed them to the rotating disk 106. The storing bowl 102 includes a head unit 102A that protrudes to the front side (the left side in FIG. 5) from the attachment base 104, and whose depth becomes deeper toward the rotating disk 106. In other words, a bottom wall 122 inclines downwardly toward the rotating disk 106. A coin slot 102B is provided for throwing in (depositing) coins C, and an outer covering unit 102C is provided that closely contacts the attachment base 104 and covers at least the lower outer circumference of the rotating disk 106. The inclination of the bottom wall 122 is the angle at which the coins C slip down to the rotating disk 106 side by their own weight. The head unit 102A is of a trough shape, where its side to the rotating disk 106 is opened, and its opened end portion is closely fixed to the attachment base 104.

At the front of the lower portion of the rotating disk 106, a narrow longitudinal slot 124 is formed, so that dropped coins C easily become upright. The longitudinal slot 124 is formed of a longitudinal wall 126 that inclines to the rotating disk 106 side to the perpendicular line roughly parallel to the rotating disk 106 formed to follow the outer covering unit 102C and the rotating disk 106 and the outer covering unit 102C. The width of the longitudinal slot 124, namely the distance between the upper surface of the rotating disk 106 and the longitudinal wall 126 of the storing bowl 102, is smaller than the diameter of the smallest coin C, and set to five times to ten times the thickness of the thickest coin C, and is so set that the distance becomes wider toward the downstream side in the rotating direction of the rotating disk 106. This is in order to provide the coins C in an upright position, further incline them to the rotating disk 106 side, and make all the coins C engage with a coin stopper 128 to be described later herein, and dispense them.

The outer covering unit 102C is of a cylindrical ring shape, and is arranged close to the outer circumference of the rotating disk 106. Therefore, coins C of different diameters are stored in bulk in the storing bowl 102, and slip down on the inclined bottom wall 122 by their own weight, and are transferred to the rotating disk 102. Further, the coins C brought by the rotating disk 106 are guided to remain on the rotating disk 106 by the outer covering unit 102C. The bottom wall 122 and the longitudinal wall 126 are interconnected by an inclined wall 127.

The attachment base 104 has functions to support the rotating disk 106 rotatably, and to fix the storing bowl 102 and the like. The attachment base 104 includes a horizontal loading board unit 104A, an attachment unit 104B inclined to the loading board unit 104A, supporting side walls 104L, 104R arranged roughly orthogonal to the loading board unit 104A, a top board unit 104D, and storing bowl attachment units 104E, 104F expanding sideward from the left and right supporting side walls 104L, 104R respectively. The loading board unit 104A is a rectangular plane, and is attached slidably into for example a game machine. The attachment unit 104B is a plane, and inclined approximately 60 degrees upwardly to the loading board unit 104A, and on the upward upper surface 104U side, the rotating disk 106 is arranged, and on the rear surface side, the drive unit 108 is attached. The inclination angle of the attachment unit 104B is preferably 50 degrees to 70 degrees. When the inclination angle of the attachment unit 104B is smaller than 50 degrees, the storage amount of the coins C becomes small, and if it is larger than 70 degrees, the coins C are apt to drop down from coin stoppers 128 to be described later herein.

The rotating disk 106 has functions to sort coins C in bulk of different diameters one by one, and to transfer them to the receiving means 112. The rotating disk 106 is a disk, and a circular center protrusion 132 is formed at the center thereof, and on the circumference of the center protrusion 132, a ring shaped holding surface 134 is formed, and on the holding surface 134, coin stoppers 128 are formed radially, and the rear surface thereof is arranged at the vicinity of the upward upper surface 104U. It is preferable that on the rear surface of the rotating disk 106, a circular ring shaped holding slot 135 is formed, and a taper roller 137 is arranged in the holding slot 135, and the load of the coins C working onto the rotating disk 106 is received via the taper roller 137 by the upward upper surface 104U. This is for saving energy and improving durability by decreasing the rotation resistance of the rotating disk 106.

The rotating disk 106 is upwardly inclined, and is rotated counterclockwise in FIG. 4. It is preferable that a protrusion is formed on the upper surface of the center protrusion 132, and coins C are stirred by this protrusion. The outer circumference of the center protrusion 132 is a supporting rack 136, and the supporting rack 136 is roughly orthogonal to the holding surface 134, and the protrusion amount from the holding surface 134 is set to be lower than the thickness of the thinnest coin SMC to be expected to be used. The supporting rack 136 has a function to make only one coin C to be held at the holding surface 134 between the coin stoppers 128. This is because two coins C are not supported by the supporting rack 136. The holding surface 134 has a function to contact one surface of the coin C whose circumferential surface is supported by the supporting rack 136. The holding surface 134 is a ring shaped partial plane formed at outer circumference of the center protrusion 132, and inclined approximately 60 degrees to the horizontal line.

Figure 8:
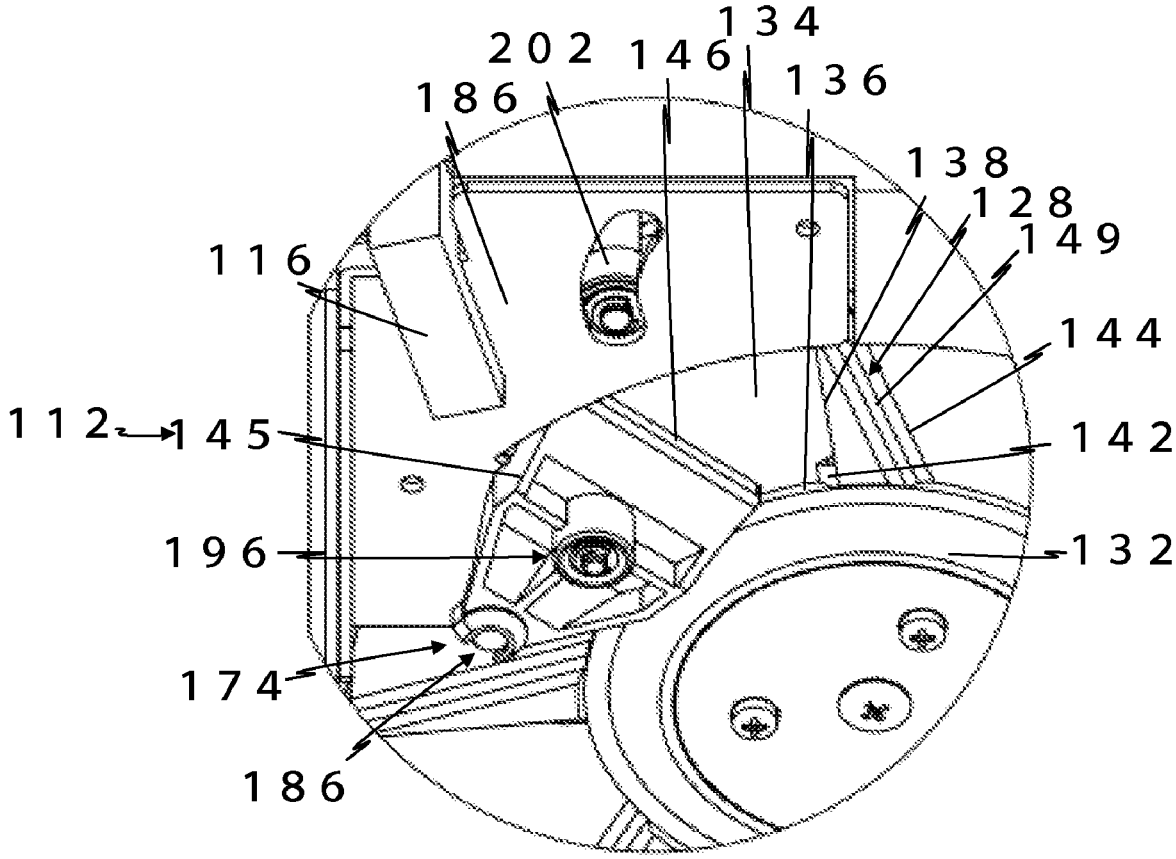
FIG. 8 is an enlarged perspective view of the region E in FIG. 4.

The coin stoppers 128 have a function to contact the circumferential surface of the coin C, and push the coin C. The coin stoppers 128 are rib shaped convex streams formed radially to the rotating axis line of the rotating disk 106 at regular intervals in fixed state. In the present embodiment, the coin stoppers 128 are trapezoidal when viewed from the front (refer to FIG. 4) and cross sectionally trapezoidal (refer to FIG. 9), and push coins C by pushing edge 138 at the front end in the rotation direction. The pushing end 138 expands vertically upward from the holding surface 134, and the height from the holding surface 134 is enough to push the coin C. However, in the case when the height of the pushing end 138 is low, the contact pressure per unit length at pushing the coin C increases, it is preferable that the height is as high as possible. However, when the height is higher than a specified amount, the length of a ride-on slope 142 for a receiving means 112 to be described later herein becomes long, and when the minimum diameter coin SMC (FIG. 11) is pushed by the pushing edge 138, it is pushed up by the ride-on slope 142, and the minimum diameter coin SMC is apt to drop down from a coin receiving body 145. Accordingly, it is preferable that the pushing end 138 is formed as high as possible in the range where the minimum diameter coin SMC is pushed by the pushing end 138, it is not pushed up by the ride-on slope 142. According to experiments, when the coin C of a diameter over 20 millimeters is used, it is preferable that the height of the pushing end 138 is approximately 2 millimeters. It is preferable that the downstream side or trailing edge 144 in a rotation direction of the coin stopper 128 is formed to be inclined to the pushing end 138 so that the full length of a receiving edge 146 of the coin receiving body 145 structuring the receiving means 112 should come close to the holding structure 134 as shown in FIG. 8 at the same time. This is because, when the receiving body 145 comes close to the holding surface 134, the coin C is not pinched between the holding surface 134 and the coin receiving body 145. The top portion 147 of the coin stopper 128 and the downstream side edge 144 are formed on a stepped inclined surface 149. One surface of the coin C contacts and is held at the holding surface 134 between adjacent coin stoppers 128. Accordingly, the distance between the pushing end 138 and the downstream side or trailing edge 144 is a shape where the supporting rack 136 side is narrow and that expands gradually toward the circumference of the rotating disk 106, and the holding surface 134 shows a reverse trapezoidal shape to the center protrusion 132. When one of the minimum diameter coins SMC to be expected to be used is supported at the supporting rack 136, other minimum diameter coins C are not supported by the supporting rack 136 (refer to FIG. 11). In other words, it is set that two pieces of the minimum diameter coins do not contact the holding surface 134 at the position vicinity of the supporting rack 136. This is for preventing counting mistake and the like when two coins are dispensed continuously.

The ride-on slope 142 has a function to push up the end portion 147 of the supporting rack 136 side of the receiving edge 146 of the coin receiving body 145 along with this from the holding surface 134. As shown in FIG. 8, the ride-on slope 142 is formed on the corner made by the supporting rack 136 and the pushing ends 138, and is a slope that inclines from the holding surface 134 to the top portion of the coin stopper 128, and when the supporting rack 136 and the pushing ends 138 and the minimum diameter coin SMC contact them, it is preferable to form it in the triangle space made by them. When the ride-on slope 142 is too large, in the state where the coins C are guided by the receiving edge 146, a part of the coins C get on the ride-on slope 142, and coins C are apt to drop down from the receiving edge 146.

Next, the drive unit 108 of the rotating disk 106 is explained with reference to FIG. 5. The drive unit 108 has a function to drive and rotate the rotating disk 108 at a specified speed. In the present embodiment, the drive unit 108 includes an electric motor 152, a decelerator 154 and a torque limiter 156. The decelerator 154 is fixed to the rear surface of the attachment unit 104B, and to its input gear, output gear (not illustrated) of the electric motor 152 fixed to the decelerator 154 is engaged. The output shaft 158 of the decelerator 154 penetrates the attachment unit 104B, and is engaged with the input shaft 162 of the torque limiter 156. The output shaft 164 of the torque limiter 156 is closely inserted to engaging hole 166 at the center of the rotating disk 106, and fixed. The torque limiter 156 has a function to prevent the rotating disk 106 from rotating by the output shaft 158, when force over a specified value works between the output shaft 158 of the decelerator 154 and the rotating disk 106. In other words, when rotation resistance over a specified value works on the rotating disk 106, the electric motor 152 continues rotating, but the rotating force is let go between the input shaft 162 and the output shaft 164 of the torque limiter 156, and the rotating disk 106 is not made to forcibly rotate. Thereby, an excessive load does not work on related parts, and accordingly there is an advantage that the durability is improved.

The coin receiving means 112 is next explained with reference to FIG. 8. The coin receiving means 112 has a function to move coins C sorted one by one and transferred by the rotating disk 106 in the circumferential direction of the rotating disk 106, and perform a retreat movement from the coin stopper 128. In the present embodiment, the coin receiving means 112 is a coin receiving body 145 that is a pentagonal plate, a receiving edge 146 whose end edge to contact the pushing edge 138 is a straight line shape is formed, and with other end portion supported movably by a free supporting means 174, and to whose center the pushing edge 138 is biased to the rotating disk 106 side by a biasing means 176. When the receiving edge 146 expands in a straight line in the circumferential direction of the rotating disk 106 from the vicinity of the supporting rack 136, and opposes the pushing edge 138 (in the case that coins C are between them), the extension lines of those edges take the form of an acute angle. In other words, as shown in FIG. 4, the receiving edge 146 offsets upward to the center of the rotating disk 106, and face the full length of the width in the circumferential direction of the holding surface 134.

Figure 9:
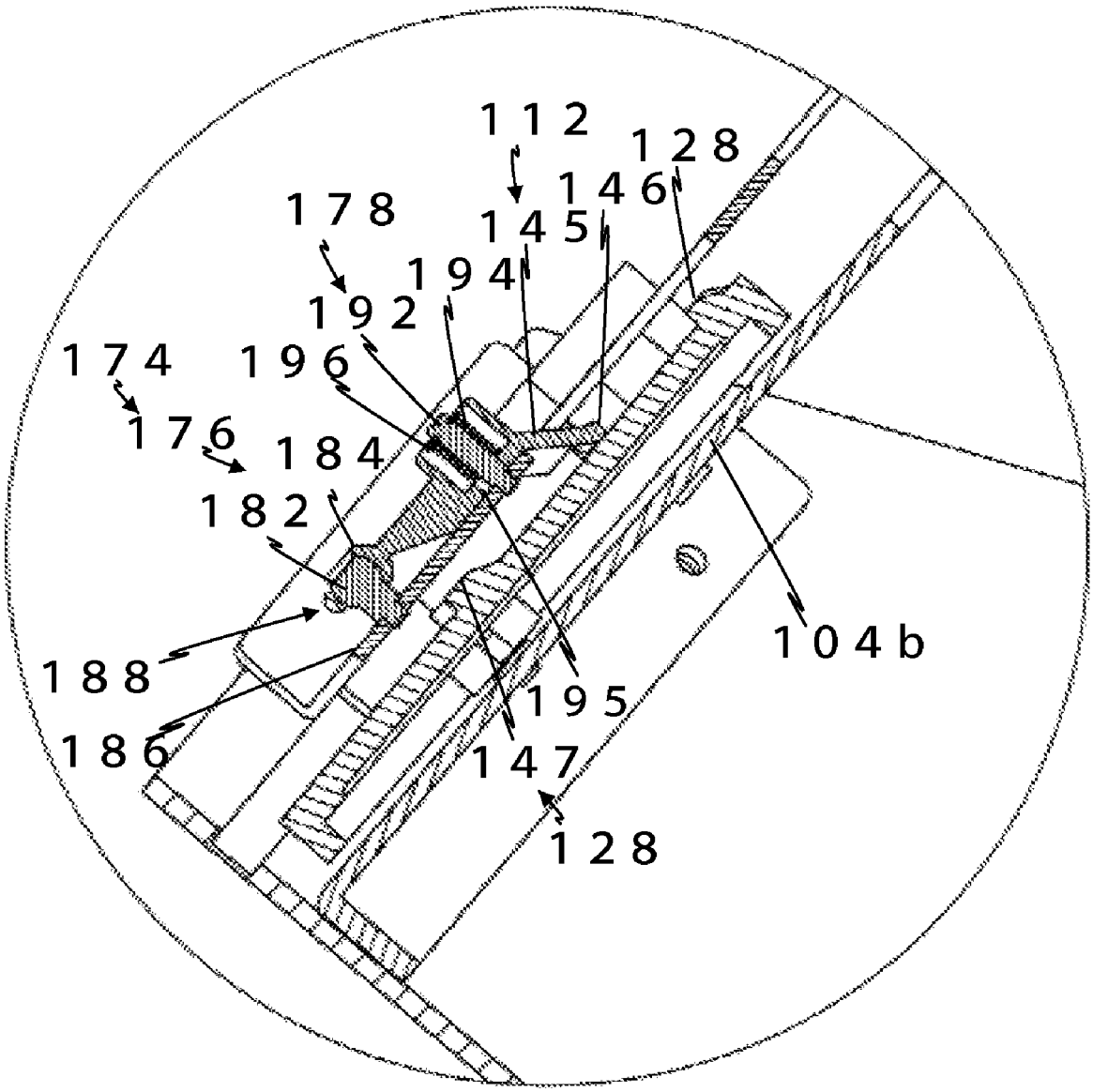
FIG. 9 is a cross sectional view taken along line F-F in FIG. 4.

The free supporting means 174 has a function to support the coin receiving means 112 changeably in any direction in a specified range. In more detail, the coin receiving edge 146 can contact the position adjacent to the holding surface 134 and the ride-on slope 142 and get over the coin stopper 128. In the present embodiment, the free supporting means 174 is a spherical bearing means 176. As shown in FIG. 9, the spherical bearing means 176 is structured by a spherical shaft 182 and a spherical bearing 184. The spherical shaft 182 is formed integrally with the storing bowl 102, and is fixed to the upper surface of a cover plate 186 that is arranged in parallel with the rotating disk 106 at the upper side of the rotating disk 106. The spherical bearing 184 is a hemisphere face that is formed at the end portion at the side opposite to the receiving edge 146 of the coin receiving body 145. The spherical bearing 184 sets the spherical shaft 182 so as to accept it from an open end portion 188, and makes it contact. Thereby, when the receiving edge 146 is pushed by the coin C, the pushing force works from the spherical bearing 184 to the spherical shaft 182, but the spherical shaft 182 receives it on surface, load per unit area is small, and durability is excellent. Further, when the spherical bearing 184 is attached to the spherical shaft 182, since the spherical bearing 184 is hemispherical, it can be engaged from the open end portion 188, and there is an advantage that it can be easily attached and detached.

The biasing means 178 has a function to make the receiving edge 146 close to the holding surface 134, and includes a supporting shaft 192 and a spring 194. The supporting shaft 192 protrudes upwardly from the cover plate 186, and penetrates a through hole 195 of the coin receiving body 145. Between a retainer 196 attached to the upper end of the supporting shaft 192 and the coin receiving body 145 upper surface, a spring 194 is arranged, and the coin receiving body 145 is pushed toward the cover plate 186 by the spring 194. The coin receiving body 145 is normally prevented from rotating by the upper surface of the cover plate 186, and the end of the receiving edge 146 is kept at standby position adjacent to the holding surface 134, and when one end of the receiving edge 146 rides on the ride-on slope 142 and the coin stopper 128, it inclines with the spherical bearing unit 176 as its supporting point, and when the full length of the receiving edge 146 rides on the top portion of the coin stopper 128, it inclines upwardly with the spherical bearing unit 176 as its supporting point, and when it gets over the coin stopper 128, the rotation is prevented by the cover plate 186 and it positions at the standby position. Meanwhile, the cover plate 186 is formed integrally with the storing bowl 102, and in parallel with the rotating disk 106.

Next, the hopping means 114 of coins C is explained with reference to FIG. 4. The hopping means 114 of coins C has a function to hop coins C guided by the receiving body 145, and moved out of the area of the rotating disk 106 to a specified direction. The hopping unit 114 of coins C includes a hopping roller 202, a swing lever 204 that supports the hopping roller 202, and a spring 208 as a biasing means 206 that elastically biases the hopping roller 202 so as to make it close to the receiving unit 112. The hopping roller 202 is attached to the end of a shaft 212 that penetrates from the rear surface side of the attachment unit 104B to the front side. The shaft 212 is fixed to the swing lever 204 that is attached rotatably to a fixed shaft 214 protruding to the rear surface of the attachment unit 104B. The swing lever 204 is biased in the counterclockwise direction in FIG. 4 by the spring 208. The hopping roller 202 protrudes to the coin route 216 set between the attachment unit 104B upper surface and the cover plate 186, and normally, is held at the standby position where the distance to circumferential side end portion 218 of the rotating disk 106 of the coin receiving body 145 is smaller than the diameter of the minimum diameter coin SMC (refer to FIG. 11). Thereby, the coin C that is guided to the receiving edge 146, when it contacts the circumferential side end portion 218, pushes up the hopping roller 202, and when the diameter portion passes through them, it is hopped out by the spring force added to the hopping roller 202.

Next, the detecting means 116 of coins C is explained with reference to FIG. 4. The detecting unit 116 has a function to detect coins C hopped out by the hopping means 114. In the present embodiment, the detecting means 116 is arranged at the coin route 216 at the downstream of the hopping means 114. The detecting unit 116 may be photoelectric or magnetic or the like, Meanwhile in the present embodiment, a transmissive type photoelectric sensor having a light projector and a light receiver that are arranged to oppose each other via the coin route 216 is employed. The end of the coin route 216 is a dispensing port 222 of coins.

Figure 10:
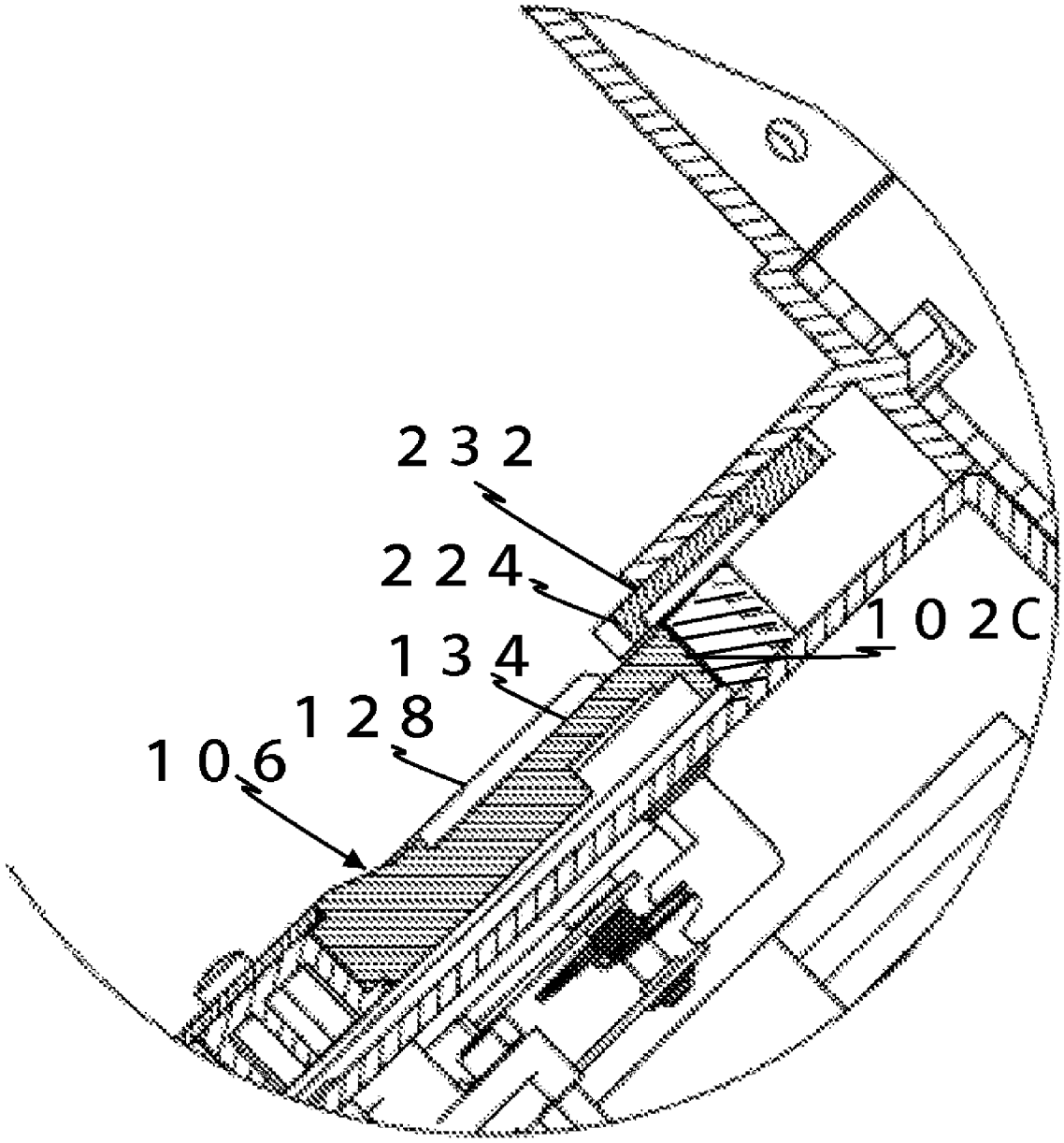
FIG. 10 is a cross sectional view taken along line G-G in FIG. 4.

Next, the dropping means 118 of coins C is explained with reference to FIG. 4 and FIG. 10. The dropping means 118 has a function to drop coin C on coin C contact to and held on the holding surface 134, so that piled coins C should not reach the receiving unit 112. The dropping unit 118 is arranged above the axial line of the rotating disk 106, and so as to oppose the circumferential edge of the rotating disk 106. In other words, the dropping means 118 is structured to be at roughly two o'clock position to the rotating disk 106, and as shown in FIG. 10, comes close to the holding surface 134 of the rotating disk 106, and can advance and retreat in a parallel plane. Specifically, the dropping lever 224 is supported swingably by a second fixed shaft 226 fixed to the attachment unit 104B, and can advance and retreat from an opening 232 of the outer covering unit 102C to the upper side of the rotating disk 106, and is received rotating force in the counterclockwise direction by the spring 236 as a biasing means 234 arranged between the right side wall 104R, and the stopper 238 contacts the back surface of the outer covering unit 102C, and thereby it is held at the standby position. When circulating or lapping coins C reach the dropping means 118, the dropping lever 224 contacts coin C that contacts the holding surface 134 and the circumferential surface of coin C that rides on it. Thereby, the coin C that rides on it is moved diagonally downward and dropped by the dropping lever 224. However, the coin C whose circumferential surface is supported by the supporting rack 136 is supported by the supporting rack 136 and does not drop. Accordingly, only one coin C contacts and is held by the holding surface 134 between the coin stoppers 128.

Next, the regulating means 120 is explained with reference to FIG. 3, and FIG. 5 through FIG. 7. The regulating unit 120 has a function to regulate the amount of coins C that flow down from the storing bowl 102 to the rotating disk 106 side. The regulating unit 120 is a regulating plate 244 that is attached swingably to a fixed shaft 242 attached rotatably to the side wall upper end portion of the storing bowl 102 just in the front of the rotating disk 106. The regulating plate 244 is normally stopped by stoppers 245R, 245L whose side edge portion underside surfaces protrude from the inside of the storing bowl 120, and becomes standstill at the following standby position. The upper portion 244A of approximately ⅔ of the upper portion of the regulating plate 244 is arranged in parallel with the rotating disk 106, and the lower end portion is separated into an upstream portion 244U facing the upstream in the rotation direction of the rotating disk 106 and a downstream portion 244D. The upper end of the upstream portion 244U is bent to the upper side portion 244A, and expands downward roughly vertically and opposes the holding surface 134, and the lower end forms an interval of approximately twice the thickest coin to the top portion of the coin stopper 128 of the rotating disk 106. The interval between the lower end of the downstream portion 244D and the holding surface 134 is set approximately one time the smallest diameter coin diameter in the same manner as the above. Thereby, it greatly regulates the amount of coins C flowing down to the rotating disk 106 portion opposing this, and securely stops coins C by the coin stopper 128. The lower end of the downstream side portion 244D is bent to the upper side portion 244A, and inclines at angle approximately 70 degrees to the horizontal line, and is formed into a crank shape bending in the reverse direction. Thereby, relatively many coins C flow down to the downstream position portion in the rotation direction of the rotating disk 106, and coins C are easily stopped by the coin stopper 128. Accordingly, regulated amount of coins C can positioned between the regulating plate 244 and the rotating disk 106, and the amount is regulated so that coins C are easily stopped by the coin stopper 128.

Next, the operation of the coin hopper 100 according to the present embodiment is explained with reference to FIG. 11 and FIG. 12Aa-12Cb. Coins C of diameters 20 millimeters or more, and 30 millimeters or below are stored in bulk in the storing bowl 102. By the rotation in the counterclockwise direction in FIG. 4 of the rotating disk 106, coins C in the front of the rotating disk 106 are stirred, and stopped by the coin stopper 128. Coins C stopped by the coin stopper 128, when its one surface contacts the holding surface 134, and positions below the center of the rotating disk 106, are apt to move to the circumferential edge direction of the rotating disk 106 by own weight, and are guided by the circumferential surface of the outer covering unit 102C and moved in the clockwise direction in FIG. 4. When coin C is positioned above the rotating shaft line of the rotating disk 106, it rolls to the supporting rack 136 side by own weight and the lower circumferential surface is supported by the supporting rack 136, and it is pushed by the pushing edge 138 and moved in the counterclockwise direction. When coins C are piled, they are not supported by the supporting rack 136 that is lower than the thinnest coin thickness, and they drop to the storing bowl 102, and between the coin stoppers 128, only one coin C contacts the holding surface 134, and is held. Further when the rotating disk 106 rotates, coin C reaches the dropping means 118. The lever 224 contacts the outer circumferential edge of coin C that contacts the supporting rack 136 and the pushing edge 138, and pushes coin C with weak force to the supporting rack 136 side. Thereby, coin C that contacts the holding surface 134 is supported by the supporting rack 136, but coin C that rides on it is not supported and is dropped into the storing bowl 102. Therefore, to the coin receiving means 112, only one coin C is supplied.

Figure 11:
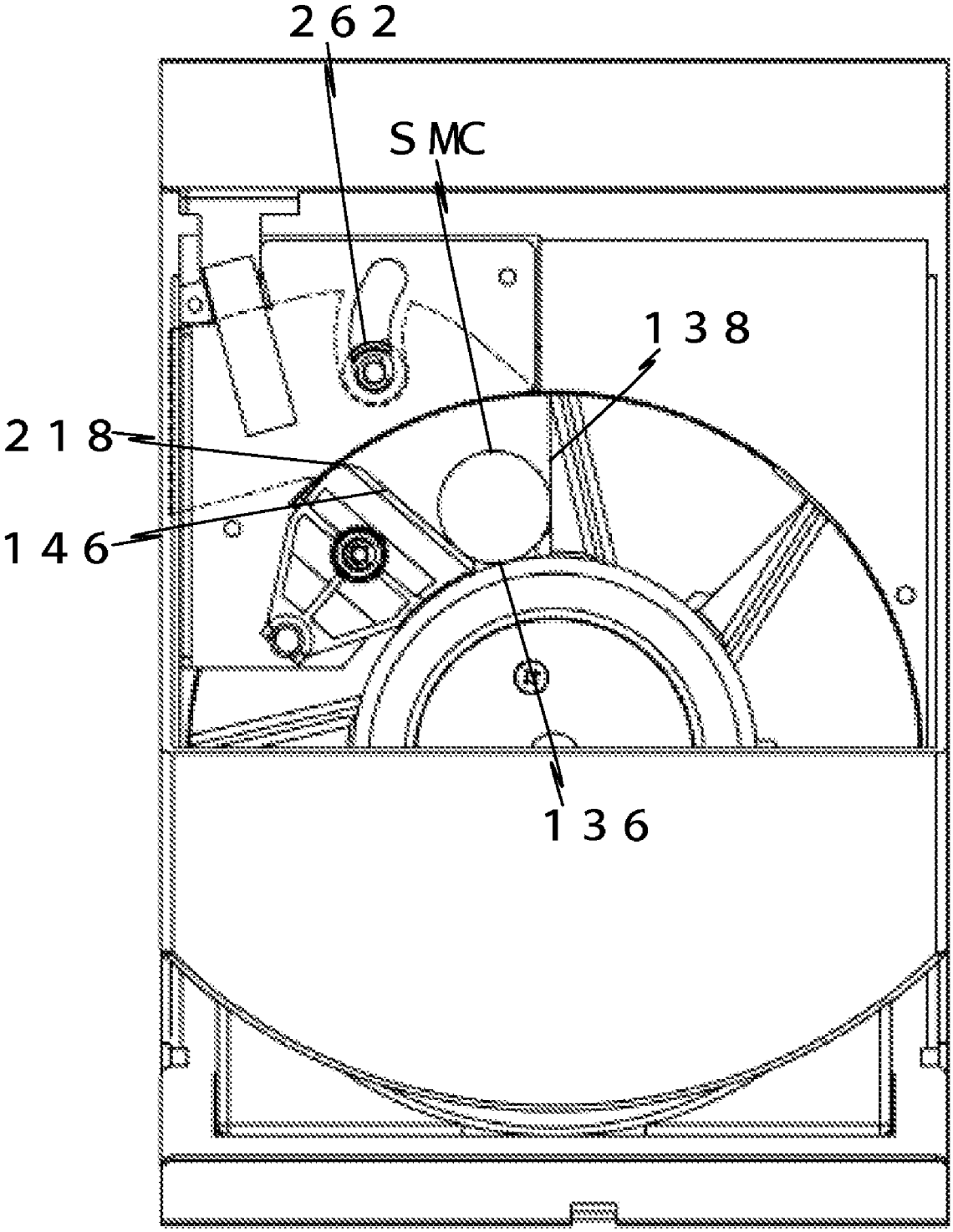
FIG. 11 is an explanatory figure showing an aspect of the operation of a coin hopper according to a preferred embodiment of the present invention.
Figure 12A:
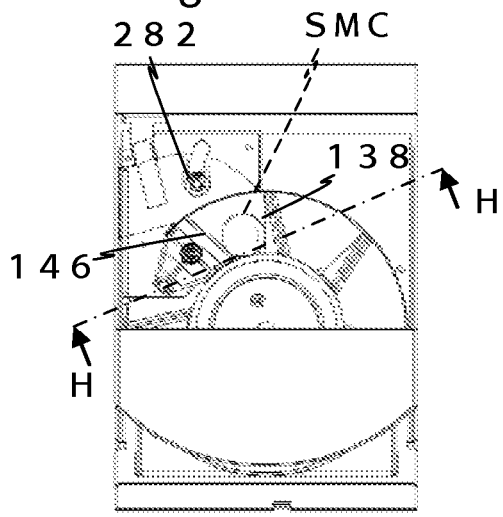
FIG. 12Aa is an explanatory sectional view showing an aspect of the operation of a coin hopper according to a preferred embodiment of the present invention.
Figure 12A:
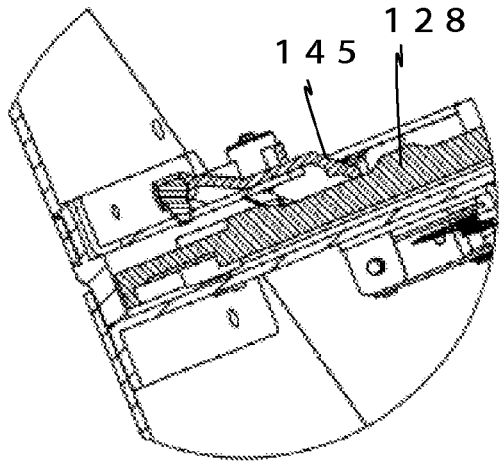
Figure 12B:
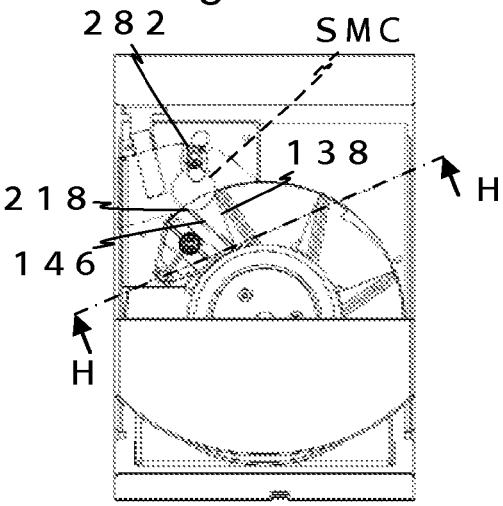
FIG. 12Ba is an explanatory sectional view showing an aspect of the operation of a coin hopper according to a preferred embodiment of the present invention.
Figure 12B:
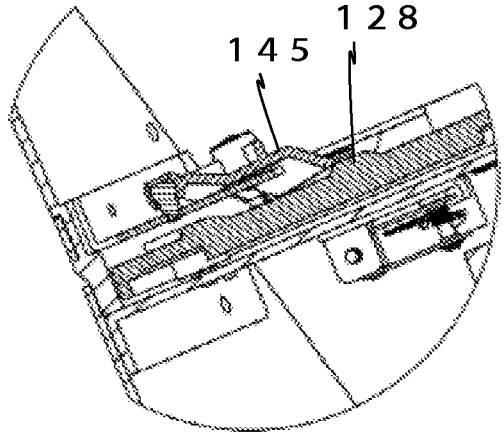
Figure 12C:
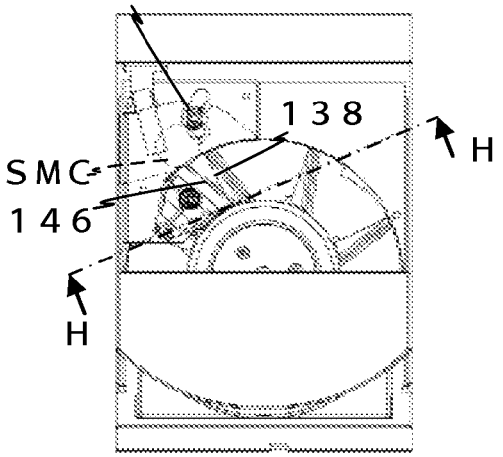
FIG. 12Ca is an explanatory sectional view showing an aspect of the operation of a coin hopper according to a preferred embodiment of the present invention.
Figure 12C:
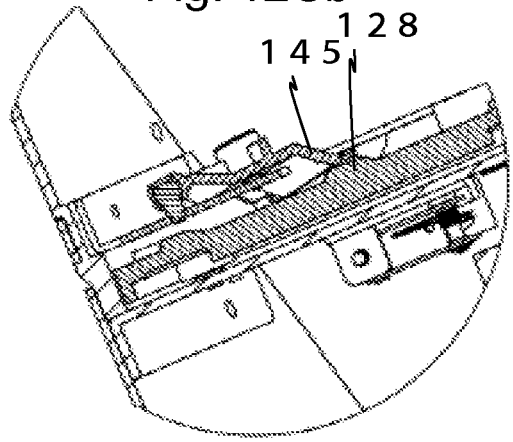

When the front end of coin C pushed by the coin stopper 128 contacts the receiving edge 146 of the coin receiving body 145, even if the smallest diameter coin SMC is held, the angle made by extended lines of the pushing edge 138 and the receiving edge 146 is an acute angle (refer to FIG. 11, FIG. 12Aa). Therefore, the smallest diameter coin SMC is pushed by the pushing edge 138 and moves along the receiving edge 146, and is moved in the circumferential direction of the rotating disk 106. When the smallest diameter coin SMC comes close to the end portion 218, the upper end of the smallest diameter coin SMC contacts the hopping roller 202 and pushes it up (refer to FIG. 12Ba). When the smallest diameter coin SMC contacts the top portion of the end portion 218, the hopping roller 202 is just before opposing the diameter portion of the smallest diameter coin SMC, and accordingly, the smallest diameter coin C is not yet hopped out. At this moment, the end portion of the supporting rack 136 side of the coin receiving means 112 slightly rides on the ride-on slope 142, and the receiving edge 146 starts slightly inclining to the holding surface 134. However, the circumferential edge side end portion 218 is far from the end portion, it is kept at the substantially same position. When the rotating disk 106 rotates further, the diameter portion of the smallest coin SMC passes between the end portion 218 and the hopping roller 202, and the hopping roller 202 hops it out to the coin route 216 by spring force of the spring 208 (refer to FIG. 12Ca). The hopped coin SMC is dispensed to the specified position from the dispensing port 222.

When the receiving edge 146 rides on the ride-on slope 142 (refer to FIG. 12Cb), the receiving edge 146 opposes the top portion of the coin stopper 128, and contacts at an acute angle (refer to FIG. 12Ca), by the further rotation of the rotating disk 106, it gets over the top portion of the coin stopper 128. After the receiving edge 146 gets over the top portion of the coin stopper 128, it contacts a downward inclined surface 149. The receiving edge 146 comes close to the holding surface 134 along the downward inclined surface 149, and at the downstream side edge 144, the full length of the receiving edge 146 comes close to the holding surface 134 at the same time. Thereby, even in the case where coin C leans to the downward inclined surface 149, the receiving edge 146 is positioned at the lower side of coin C, it pushes up coin C, and makes it drop into the storing bowl 102. Therefore, coin C is not pinched between the coin receiving means 112 and the rotating disk 106. The coin C that passes through the coin route 218 is detected by the detecting means 116, and the detecting unit 116 outputs a detection signal. The detection signal is used for counting of dispensed coins C and the like. The above operation is same also to large diameter coins.

If the coin C is pinched between the receiving edge 146 and the pushing edge 138 and does not move, the rotating disk 106 cannot rotate, and by the drive from the electric motor 152, the free supporting means 174 of the coin receiving body 145 receives a large force. However, since the torque limiter 156 is interposed between the electric motor 152 and the rotating disk 106, when a toque over the set torque is added, the electric motor 152 runs idle. Therefore, there is an advantage that it is possible to prevent the free supporting means 174 and the like from being damaged.

While specific embodiments of the invention have been shown and described in detail to illustrate the application of the principles of the invention, it will be understood that the invention may be embodied otherwise without departing from such principles.

APPENDIX

102 Storing bowl
102C Outer covering unit
106 Rotating disk
108 Rotating drive means
112 Coin receiving means
118 Dropping means
120 Regulating means
128 Coin stopper
134 Holding surface
136 Supporting rack
144 Downstream side edge
156 Torque limiter
174 Free supporting means
176 Spherical bearing means
178 Biasing means

What is claimed is:

1. A coin hopper comprising:

a rotating disk with a holding surface having coin stoppers that are upwardly inclined at a specified angle relative to a circular supporting rack formed at the center of said holding surface, said coin stoppers extending radially and being disposed at regular intervals, coins contacting said holding surface between said coin stoppers and receiving the coins one by one, supported by said supporting rack for feeding out;

an outer covering unit that covers at least the lower outer circumferential region of said rotating disk;

a storing bowl for storing coins in bulk above said outer covering unit; and a coin receiving unit extending from a vicinity of said supporting rack in the circumferential direction of said rotating disk, said coin receiving unit being positioned relative to said rotating disk for moving coins held between said supporting rack and said coin stoppers radially away from said rotating disk and out of said storing bowl, said coin stoppers being arranged in a state fixed to said rotating disk, said coin receiving unit being movably arranged so as to contact and move away from said holding surface of said rotating disk, each of said coin stoppers including a ride-on slope arranged to cause said coin receiving unit to slide away from said holding surface and over a respective said coin stopper.

2. A coin hopper according to claim 1, further comprising;

a free supporting unit, said coin receiving unit being supported so as to freely move in a specified range above said rotating disk by said free supporting unit; and a biasing means, said receiving means being biased by a specified force so as to come close to the holding surface of the rotating disk by said biasing means.

3. A coin hopper according to claim 2, further comprising a spherical bearing as a free supporting unit for supporting the coin receiving unit.

4. A coin hopper according to claim 2, wherein each downstream side edge portion of said coin stoppers, in a rotating direction, has a specified angle to said supporting rack, so that when the respective edge opposes said coin receiving unit, said coin receiving unit contacts the holding surface at the same time.

5. A coin hopper according to claim 1, further comprising a dropping means for biasing coins toward said supporting rack at an upper portion from a center of said rotating disk.

6. A coin hopper according to claim 1, wherein:

said ride-on slope slides said coin receiving unit away from said holding surface in a direction normal to said holding surface.

7. A coin hopper according to claim 1, wherein:

each of said coin stoppers includes a pushing edge for pushing one of the coins in a direction of rotation of said disk, said pushing edge extending from said holding surface in a direction normal to said holding surface, said each coin stopper also includes an inclined surface extending from a top of said pushing edge in a trailing direction to said holding surface;

said coin receiving unit sliding down said inclined surface of said each coin stopper as said each coin stopper is rotated past said coin receiving unit.

8. A coin hopper according to claim 1, wherein:

each of said coin stoppers includes a pushing edge for pushing one of the coins in a direction of rotation of said disk, said pushing edge extending from said holding surface in a direction normal to said holding surface, said each coin stopper also includes an inclined surface extending from a top of said pushing edge in a trailing direction to said holding surface, said inclined surface meeting said holding surface at a trailing edge;

said coin receiving unit having a receiving edge, said receiving edge of said coin receiving unit and said trailing edge of said each coin stopper being substantially parallel when said disk is rotated to have said receiving edge contact said trailing edge.

9. A coin hopper comprising:

a drive;

a disk driven in rotation by said drive, said disk having a holding surface and having coin stoppers arranged in a state fixed to said disk and extending radially outwardly from a circular supporting rack formed at a center of said holding surface, coins contacting said holding surface between said coin stoppers being supported by said supporting rack for feeding out;

a storing bowl for storing coins in bulk above said disk; and a coin receiving unit extending in the circumferential direction of said rotating disk from a vicinity of said supporting rack, said coin receiving unit being positioned relative to said disk for moving coins held between said supporting rack and said coin stoppers radially away from said disk and out of said storing bowl, said coin receiving unit contacting and moving away from said holding surface of said rotating disk in a direction normal to said holding surface.

10. A coin hopper according to claim 9, further comprising a spherical bearing as a free supporting unit for supporting the coin receiving unit.

11. A coin hopper according to claim 9, wherein:

each of said coin stoppers includes a ride-on slope arranged to cause said coin receiving unit to slide away from said holding surface and over a respective said coin stopper in a direction normal to said holding surface.

12. A coin hopper according to claim 11, wherein:

each of said coin stoppers includes a pushing edge for pushing one of the coins in a direction of rotation of said disk, said pushing edge extending from said holding surface in a direction normal to said holding surface, said each coin stopper also includes an inclined surface extending from a top of said pushing edge in a trailing direction to a following said holding surface;

said coin receiving unit sliding down said inclined surface of said each coin stopper as said each coin stopper is rotated past said coin receiving unit.

13. A coin hopper according to claim 9, wherein:

each of said coin stoppers includes a pushing edge for pushing one of the coins in a direction of rotation of said disk, said pushing edge extending from said holding surface in a direction normal to said holding surface, said each coin stopper also includes an inclined surface extending from a top of said pushing edge in a trailing direction to said holding surface, said inclined surface meeting said holding surface at a trailing edge;

said coin receiving unit having a receiving edge, said receiving edge of said coin receiving unit and said trailing edge of said each coin stopper being substantially parallel when said disk is rotated to have said receiving edge contact said trailing edge.

14. A coin sorting arrangement comprising:

a housing;

a storing bowl mounted on said housing and for storing coins;

a disk rotatably mounted in said storing bowl, said disk including a holding surface, an outer edge and a circular supporting rack arranged radially inward of said outer edge of said disk, said disk including a plurality of coin stoppers fixed to said disk and extending radially outwardly from said circular supporting rack, said supporting rack, said holding surface and said coin stoppers being arranged to remove and hold one of the coins from said storage bowl as said disk rotates in said storage bowl, the coin being held between said circular supporting rack and one of said coin stoppers on said holding surface;

a coin receiving unit attached to said housing and arranged adjacent said holding surface of said disk between said supporting rack and said outer edge of said disk, said coin receiving unit being positioned relative to said disk for moving coins held between said supporting rack and said coin stoppers radially away from said disk and out of said storing bowl, said coin receiving unit being arranged to slide over said coin stoppers in a direction normal to said holding surface as said disk rotates said coin stoppers past said coin receiving unit.

15. An arrangement in accordance with claim 14, wherein:

said coin receiving unit slides along said holding surface of said disk.

16. An arrangement in accordance with claim 14, wherein: said coin receiving unit is attached to said housing by a spherical bearing.

17. An arrangement in accordance with claim 14, wherein: said coin receiving unit is attached to said housing to pivot about a plurality of axes.

18. An arrangement in accordance with claim 17, wherein: said plurality of axes are substantially parallel to said holding surface.

19. An arrangement in accordance with claim 14, wherein: each of said coin stoppers includes a ride-on slope arranged to cause said coin receiving unit to slide away from said holding surface and over a respective said coin stopper in a direction normal to said holding surface.

20. An arrangement in accordance with claim 17, wherein: said coin receiving unit has a receiving edge which initially contacts the coin;

each of said coin stoppers includes a ride-on slope arranged to cause said coin receiving unit to slide away from said holding surface and over a respective said coin stopper in a direction normal to said holding surface, said ride-on slope lifts one part of said receiving edge of said coin receiving unit further away from said holding surface than another part of said receiving edge of said coin receiving unit.

* * * * *